US005657518A

United States Patent [19]

Hunt

[11] Patent Number: 5,657,518

[45] Date of Patent: Aug. 19, 1997

[54] CLIP FOR GARMENT HANGER

[75] Inventor: William Joseph Hunt, Bucks, United Kingdom

[73] Assignee: Braitrim (UK) Ltd., London, England

[21] Appl. No.: 500,865

[22] PCT Filed: Feb. 4, 1994

[86] PCT No.: PCT/GB94/00206

§ 371 Date: Nov. 1, 1995

§ 102(e) Date: Nov. 1, 1995

[87] PCT Pub. No.: WO94/17706

PCT Pub. Date: Aug. 18, 1994

[30] Foreign Application Priority Data

Feb. 5, 1993 [GB] United Kingdom ..... 9302310
Jun. 18, 1993 [GB] United Kingdom ..... 9312582

[51] Int. Cl.[6] ..... A44B 21/00; A47G 25/00

[52] U.S. Cl. ..... 24/543; 24/489; 24/557

[58] Field of Search ..... 24/543, 489, 545, 24/557, 487, 346

[56] References Cited

U.S. PATENT DOCUMENTS

| | | | |
|---|---|---|---|
| 3,698,043 | 10/1972 | Batts | 24/543 |
| 3,745,616 | 7/1973 | Batts . | |
| 4,807,334 | 2/1989 | Blanchard . | |
| 4,835,824 | 6/1989 | Durham et al. | 24/543 |
| 5,313,721 | 5/1994 | Filden | 24/543 |

FOREIGN PATENT DOCUMENTS

| | | |
|---|---|---|
| 38851 | 12/1969 | Australia . |
| 447689 | 3/1968 | Switzerland . |
| 2177593 | 1/1987 | United Kingdom . |
| 2246388 | 1/1992 | United Kingdom . |
| 9207496 | 5/1992 | WIPO . |

*Primary Examiner*—Victor N. Sakran
*Attorney, Agent, or Firm*—Ladas & Parry

[57] ABSTRACT

There is disclosed a clip for a garment hanger on which clothes are hung directly, and which has front and rear gripping plates which are movable one relative to the other. A locking mechanism, preferably in the form of an arm in a fixed one of the two plates interlocks the movable plates for gripping a garment within the clip. A movable pressure device preferably mounted on the movable one of the plates is used to effect release of the locking means and immediately the locking means is released, the pressure device acts directly on the movable plate to force it away from the other plate to thereby quickly and easily release a garment previously held within the clip. In an alternative, a flange extends from the movable plate and has locking tooth thereon engageable with teeth on the release arm. The flange extends across the teeth in use to prevent delicate garments becoming entangled in the locking mechanism between the movable plates. Such constructions are particularly useful with soft clear plastics materials such as K-resin co-polymers.

18 Claims, 2 Drawing Sheets

CLIP FOR GARMENT HANGER

This invention relates to a garment hanger clip.

It is well known to provide garment hangers with clips in the form of two overlying gripping members on each outwardly extending arm of the hanger, usually at the extreme outer ends thereof. The gripping members at the outer ends are usually integrally moulded with the arms of the hanger although it is possible for the gripping members to be slidable along hanger arms. The garment clips are in a number of different forms but in the main take the configuration of having a fixed back plate integrally moulded with the relevant arm of the hanger and a front plate which is pivotally interconnected with the back plate and which when disconnected by releasing locking means therebetween can be pivoted upwardly about the interconnecting hinge. The locking means comprises a generally L-shaped arm extending outwardly from the back plate with which it is integrally moulded, in the direction of the front plate to extend into an aperture in the front plate, in a closed position of the clip, the locking being effected between one edge of the aperture and an outwardly extending rib on the L-shaped arm. The release of the front plate is usually effected by pressing on the free end of the L-shaped arm to move its locking rib away from the edge of the aperture on which it is locked thereby releasing the front plate.

Users of hangers having such clips at the ends of the arms firstly have to be certain that the clip is of sufficient strength to support garments placed between the gripping members. It is also necessary that the clip be releasable easily by a person applying pressure to the free end of the L-shaped arm to move it against its inherent resilience. It is usual to effect such operation by applying pressure of the thumb against the lug whilst a finger is resting on the further or remote surface from the front plate in region of the hinge between the front and rear plates.

With hangers that are formed from polypropylene, a relatively hard opaque material, the opening of the clip is not so much of a problem because of the inherent strength and resilience of the material and a relatively short arm can be used to achieve the release of the front plate. Moreover, as the gripping feature between the arm and front plate has been improved by various manufactures the polypropylene type hangers have been able to remain operative without any detrimental effect upon the locking arm.

However, when hangers are produced of a much softer material such as K-Resin, which is a clear plastics material with much lower inherent resilience and more likely to fracture, the locking arm is liable to a high rate of breakage. This particular problem has been met to some extent by increasing the length of the part of the arm which sits or projects through the aperture in the front plate. K-Resin is a styrene-butadiene copolymer and is hereinafter referred to as K-Resin.

It has been known to increase the length of the arm to extend beyond the edge of the back plate so that the user of the hanger can clearly see. However, the difficulty with this particular solution as far as manufacturers are concerned is that they are unable to mould the grip without a particularly intricate and expensive form of mould to mould an integral hinge portion and outwardly extending portions therefrom of the front substantially alleviated.

It is an object of the present invention to provide a garment hanger with a clip in which the above mentioned disadvantages have been at least in part overcome.

According to the present invention there is provided a clip for a garment hanger comprising front and rear interconnected gripping plates movable one relative to the other and locking means for interlocking the said plates, characterised in manually operable pressure means being operable for urging outward movement of one of the gripping plates directly upon operation of the locking means to release the locking means.

In one preferred embodiment of the clip according to the present invention the front and rear plates are pivotally interconnected by a hinge along one edge thereof.

In another preferred embodiment of a clip according to the present invention the pressure means is mounted on the movable plate. Preferably, the pressure means is integrally moulded with the movable plate and is arranged to project, in a closed position of the clip, through an aperture in the non-movable plate.

Conveniently, the pressure means comprises side members projecting perpendicularly from the movable plate and a plate mounted on and extending between the side members.

In an alternative embodiment according to the present invention the locking means for interlocking the front and rear plates comprises a plurality of teeth forming a sawtooth arrangement on one plate member and an interengageable tooth on the other plate member.

Preferably, the plurality of teeth are located on the release arm and the interengageable tooth on a flange extending from the front plate. The flange conveniently extends from an edge of the aperture in the front plate through which the release arm projects with the clip in a closed or semi closed position.

In another embodiment according to the present invention the release arm is provided with a strengthening rib which preferably has an end face engageable by the pressure member.

Conveniently, the end face is sloped to lock the pressure member against further movement of the pressure member in a direction towards the end face. Preferably the end face is stepped with the pressure member engageable with and outermost part of the step relative to the release arm.

The pressure member is preferably provided with an extended edge which is engageable with the end face of the strengthening rib. Conveniently the extended edge is angled relative to the pressure member to more firmly interlock the rib and pressure member.

Advantageously, the structure of the alternative embodiment the flange protects the hinge arrangement of the clip and also protects against delicate articles of clothing to be inserted into the clip from being accidentally caught in the interlocking mechanism between the release arm and front plate. this results in a clip which is much easier to load than hitherto available.

The clip may be a one piece integral moulding utilising a soft clear plastics material such as K-Resin.

An embodiment of the present invention will now be described by way of example, with reference to the accompanying drawing, in which.

Figure 1:
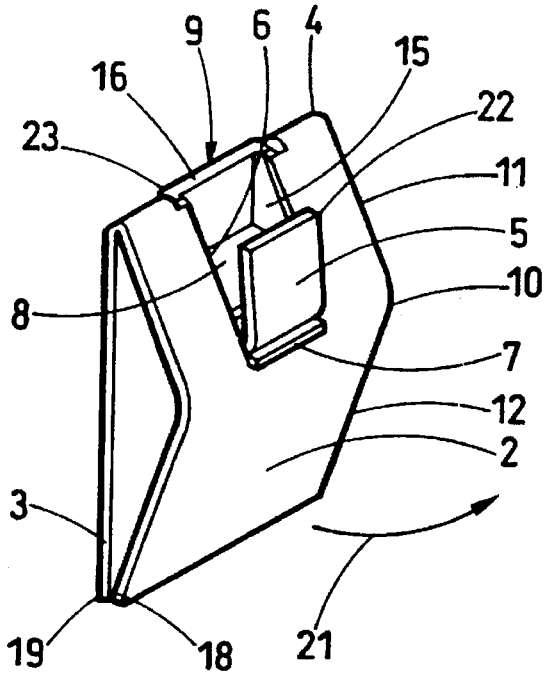
FIG. 1 is a side perspective view of a clip according to the present invention in a closed position.
Figure 2:
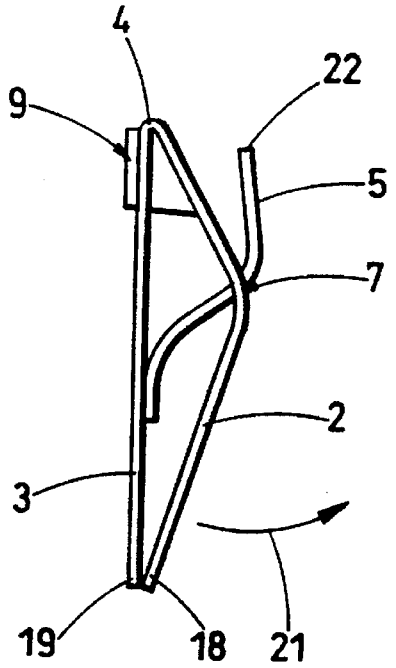
FIG. 2 is a side elevational view of the clip of FIG. 1.
Figure 3:
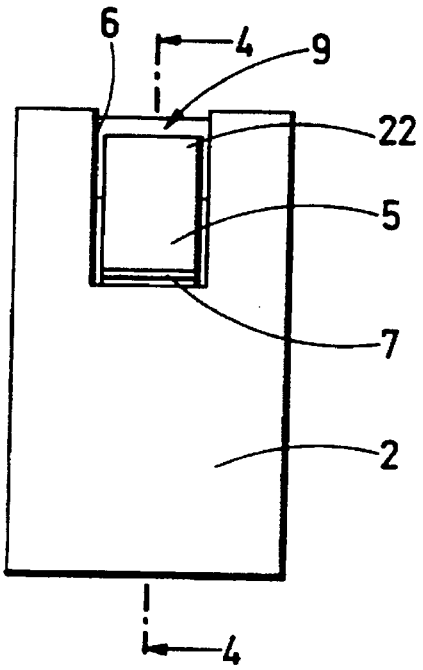
FIG. 3 is a rear elevational view of the clip of FIG. 1.
Figure 4:
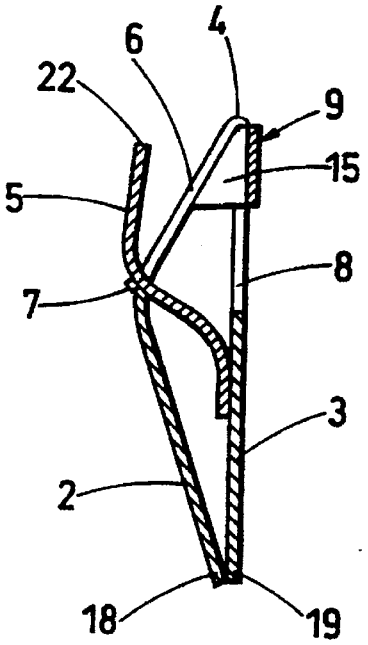
FIG. 4 is a cross-sectional view along line 4—4 of the clip as illustrated in FIG. 3.

Referring specifically to FIGS. 1 to 4 there is shown a clip i for a garment hanger which comprises front and back plates 2, 3 pivotally hinged together at 4. A elongate S-shaped locking or release arm 5 is fixed to the back plate 3 and extends, in the closed position in FIG. 1, through an aperture 6 in the front plate. A locking rib 7 extends outwardly from the locking arm 5 to prevent pivotal movement of the front plate by engaging the outer face thereof.

The rear plate 3 is an elongate flat planar rectangular plate structure as shown in the drawings having an aperture 8 therein through which an elongate pressure member 9 of the front plate 2 extends, in the closed position of the clip.

The front plate 2 has a bend 10 below the aperture 6 therein relative to the hinge 4, with two front portions 11, 12 which lie at an angle relative to the back plate 3 in the closed position.

The pressure member 9 of the front plate 2 extends rearwardly from the front portion 11 through aperture 8 of the rear plate 3. Member 9 comprises two side plates 15 attached to the front portion 11 and an interconnecting plate 16 extending from one side plate to the other side plate.

In considering the operation of the clip device it is assumed initially the clip is in its closed position gripping a garment between its free ends 18, 19 remote from the hinge 4. In this closed position the locking rib 7 on arm 5 is engaged with the lowermost edge 20 of the aperture 6 of the front plate 2. The interengagement of the locking rib 7 with the outermost surface of the front plate 2 prevents pivotal movement of the front plate about the hinge 4 in the direction of arrow 21.

To open the clip to release the garment held therein pressure is applied, generally between the thumb and first finger which are respectively engaged with free end 22 of the arm 5 and rear surface 23 of the bar 16.

With an inward pressure of the thumb and forefinger the free end 22 of the locking arm 5 will move inwardly towards the rear plate 3 disengaging the locking element 7 from the front face of the front plate 2. Immediately upon release of the front plate 2 pressure applied to the rear surface 23 of the plate 16 is maintained momentarily but of a sufficient time to push the front panel 2 outwardly in the direction of the arrow 21 thereby easily and quickly releasing the garment which had been held between the front and rear panels 2,3. Accordingly, the particular surprising effect to be gained from this construction is that the pressure which would normally be applied to a release lever usually would be relative to a fixed surface but now such pressure on the rear plate is directed to a part of the front plate and thereby assists in the movement of the front plate rather than simply providing for the disengagement by movement of the release arm alone.

Whilst the present invention has been described with reference to the particular embodiment disclosed in the drawings the clip can be provided in a number of different shapes and sizes and need not necessarily be of a rectangular planar construction. Moreover, the pressure plate 9 need not necessarily project through the aperture 8 of the rear plate 3 to the extent illustrated in FIG. 2. The pressure plate 9 can be flush with the rear surface of the rear plate 3 or may be inset relative to the rear surface. In any event, it is essential that an operator's fingers can easily engage the pressure plate 9 so that immediately the locking rib 7 is disengaged from the front plate 2 the force upon the plate 9 will urge the front plate 2 in the direction of the arrow 21 to open the clip.

The clip is preferably of a one piece moulding of a soft clear plastics material such as R-Resin. Although specifically designed for garment hangers manufactured from plastics material the invention disclosed herein can equally be applied to clips which are of a harder plastics material such as polypropylene. Alternatively, the arm 5 and pressure plate 9 can be made separately and attached to the respective parts by gluing, heat welding, ultrasonic welding or by a mechanical attachment such as rivets or screws, as the case may be.

The locking rib 7 is integrally moulded with arm 5 and is described as being an elongate rib but such rib may be a single pip like projection or plurality of pip like projections extending in a line across the outer face of plate 2 and extending outwardly from the arm 5. In any event, there may be two or more such ribs or rows of pips lying one below the other in the drawings so as to provide a plurality of locking positions for supporting various thicknesses of garments.

In at least one embodiment of the present invention the facing surfaces, in the closed position of the front and rear plates 2, 3 in the region of their free ends 18, 19, respectively, may be provided with one or more raised surfaces which serve to assist in holding the garment in place between the free ends of the plates 2, 3.

Conveniently, the clip described herein may be permanently or slidably attached to the arm of a garment hanger, and that arm may itself be either fixed or variable in length. Alternatively, the clip may be used independently with its own hook or other support as a garment hanger.

Conveniently, and as seen in FIG. 1, free end 22 of the locking arm 5 is below the level of the hinge 4 so that during moulding of the clip as a one piece moulding the free end of the arm 5 does not obstruct the mould when forming the hinge portion of the clip, which at that point is of a slightly reduced thickness.

Whilst the pressure plate 9 is described as being located on front plate 2 it is envisaged the invention will extend to include a construction in which the pressure plate 9 is mounted on rear plate 3 but transfers applied pressure to the front plate. Alternatively, the pressure plate may be mounted on the locking member and as the locking member is disengaged it moves the pressure member against the inner surface of the movable plate to urge it away from the other plate.

An alternative embodiment according to the present invention is shown in FIGS. 5 to 8 and as far as the clip shown therein is concerned parts which are similar to the parts already described in respect of the embodiments in FIGS. 1 to 4 bear the same reference numerals and will not be described further because the parts generally operate in the same manner as previously described with reference to that particular embodiment.

Figure 5:
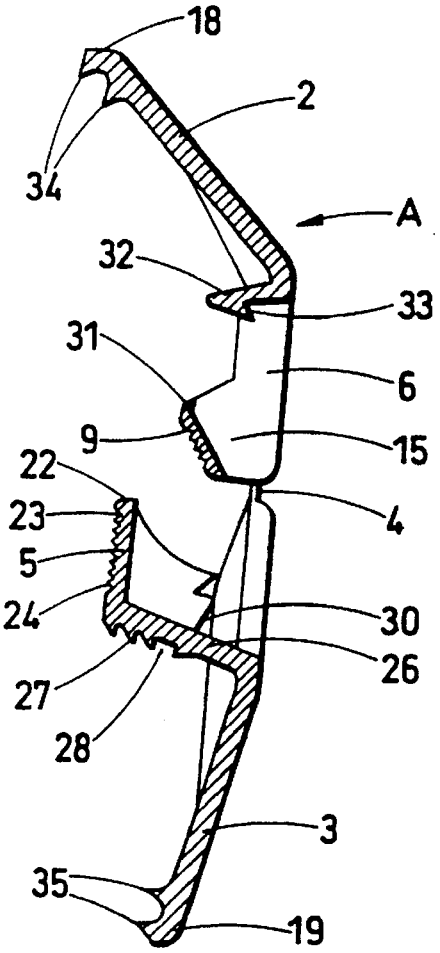
FIG. 5 is a cross-sectional view along line 5—5 of FIG. 8 with the arms of the clip in a fully opened extended position.
Figure 6:
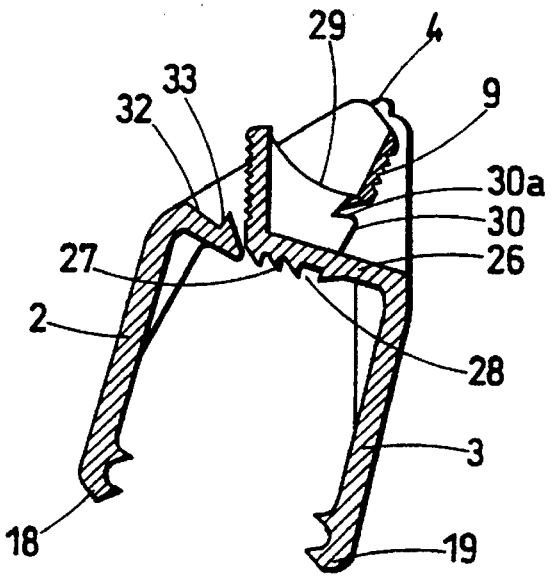
FIG. 6 is a cross-sectional view of the clip of FIG. 5 in the normally opened position.
Figure 7:
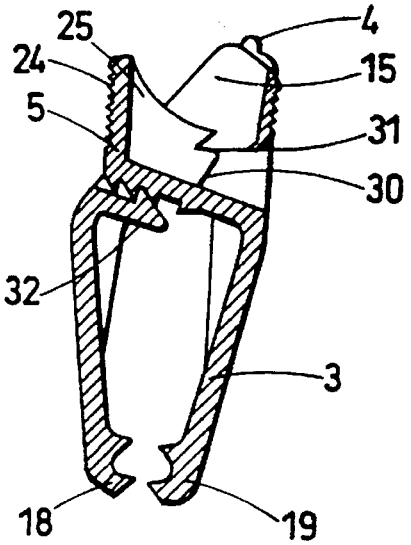
FIG. 7 is a cross-sectional view of the clip of FIG. 5 in a mid opened position.
Figure 8:
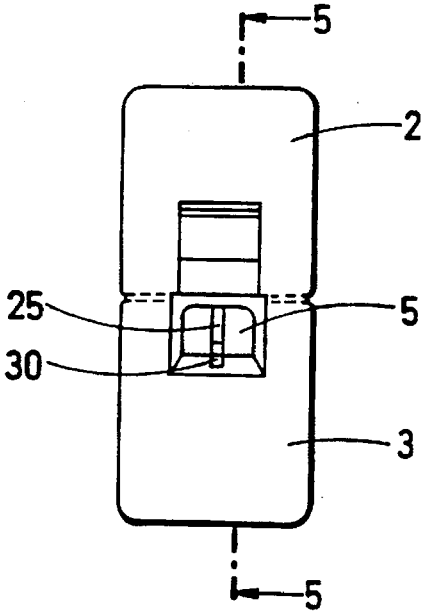
FIG. 8 is a view on a reduced scale of the clip when viewed in the direction of the arrow A in FIG. 5.

Referring particularly to FIGS. 5, 6 and 7 the clip has front and back plates 2,3 which are pivotally hinged together at 4. Locking release arm 5 is integrally formed with the back plate 3 and in this embodiment appears more as an L-shaped arm having on arm 23 thereof, on the face remote from the back plate 3, a plurality of serrations 24 to assist gripping of the release arm. A strengthening rib 25 integrally moulded with the back plate 3 extends transversely relative to the arm 23 and along arm 26 of the L-shaped release arm 5. Teeth 27 on the arm 26 replace the locking rib 7 on the side of the arm 26 remote from that from which the rib 25 extends. The teeth 27 comprise a rectangular shaped elongate recess 28 extending across the face of the arm 26 together with three teeth having a sawtooth configuration with their sloping surfaces directed towards the serrations 24 of release arm 5.

The strengthening rib 25 is provided with a curved surface 29 extending from free end 22 of the arm 5 downwardly in FIG. 5 towards arm 26. End face 30 of the rib is provided with a sloped stepped recess 302 which in operation of the device will be engageable as described with lower edge 31 of the elongate pressure member 9, shown in FIG. 6. The lower edge is angled inwardly from pressure member 9 for interlocking firmly with the sloped end face of the strengthening rib.

Front plate 2 includes a flange 32 integrally moulded with the front plate 2 and extending outwardly therefrom in the same direction as pressure member 9. The flange 32 carries a locking tooth 33 extending across the width of aperture 6. The tooth 33 as shown in FIGS. 5, 6 and 7 is directed inwardly into the aperture 6 with the opposite side of the flange 32 being a smooth straight surface. The tooth 33 interlocks with teeth 27 whilst the flange extends over the interlocking teeth to prevent garments becoming entangled with the teeth or to pass between the movable members and extend through aperture 6 or over release arm 5.

Conveniently, the ends 18, 19 of the front and rear plates 2 and 3, respectively, are provided with two inwardly directed teeth 34, 35, respectively which interengage in the fully closed position of the clip.

The operation of the clip from a totally closed position will now be described, in which the tooth 33 is in engagement with the recess 28 and the teeth 34, 35 interengage each other. The fully closed position is substantially as shown in FIG. 7 with the arms moved closer together and the teeth 34,35 in engagement with each other. The tooth 33 in this position is located in recess 28.

Upon pressure applied to both the release arm 5 and the pressure member 9 between an operators forefinger and thumb, for example, the resilient arm 5 disengages from the tooth 33 releasing it from the recess 28. Immediately, the pressure applied to the pressure member 9 forces the front plate 2 away from the front plate 3 and because of the arc of rotation of the front plate 2 tooth 33 engages with the first two teeth 27 on the arm 26 to catch the clip in a mid position as shown in FIG. 7 with the flange 32 extending over the teeth 27 when viewed through the open jaws 18, 19. Further pressure upon the release arm 5 and pressure member 9 disengages the tooth 33 from the teeth 27 until a position shown in FIG. 6 is achieved when the front and rear arms 2 and 3 lie substantially parallel and the edge 31 of plate 9 engages the stepped surface 30 of the strengthening rib 25. Thus the jaws are fully opened for all usual garments which are to be hung on the clip to be received therein. The resilience of the material from which the clip is made allows the edge 30 to be distorted upon further pressure applied to the arms 5 and pressure member 9 to release the pressure member 9 from the stepped surface 30 and to allow the clip to be opened completely to the position shown in FIG. 5.

The particular advantages to be gained by the construction in this alternative embodiment is that the flange 32 has the effect of protecting the hinge but also prevents delicate articles of underwear, for example, which are made from silk or satin from being forced into the interlocking mechanism between the arm 5 and the opening of the aperture 6 as would likely be the case in the embodiment as shown in FIG. 1 if the operator was not sufficiently careful. Accordingly, the clip of FIGS. 5 to 8 is much easier to load and the operator/customer using a hanger with such clips does not have to think carefully and take particular care when reloading an article on the hanger.

Although the teeth 26 have been described as extending across the complete face of the arm 26 of the release arm 5, the teeth could of course be of much shorter length across this face as could the elongate tooth 33 of the flange 32. Alternatively, the teeth could be formed as a series of shaped pips conveniently having a sawtooth configuration.

Whilst the plates 2, 3 and flange 32 are shown to be straight elongate members there could take alternative shapes and the surface of the flange facing the jaws 18, 19 in FIGS. 6 and 7 may conveniently present a concave surface to assist in directing garments away from the interlocking means between the front and back plates.

The clip of FIGS. 5 to 8 is made of the same materials as the clip of the previous described embodiment herein.

Conveniently, the clip is usable on its own or when mounted on the arms of a garment hanger.

Therefore, there has been described clips for hanging garments therefrom, the clip being of a soft clear plastics material being securely lockable, easy to operate and very durable in use. Although the clips have been described as being of K-Resin other soft plastics materials can be used such as PVC (Polyvinylchloride), high and low density polyethylene, cellulose acetate, and styrene acrylonitrile (SAN).

I claim:

1. A clip for a garment hanger comprising first gripping plate means, second gripping plate means arranged to be pivotally interconnected to the first gripping plate means at a point remote from gripping portions at a gripping end of each plate means, manually operable pressure means located on the said first and second gripping plate means between the pivotal interconnection of the first and second plate means and the gripping portions thereof, respectively and locking means mounted on the manually operable pressure means on one of the plate means for interlocking with the other of the plate means, so that upon applying pressure to the manually operable pressure means to release the locking means, the first and second gripping plate means are forced to move apart relative to each other by the same pressure forces applied to the manually operable pressure means to release the locking means.

2. A clip as claimed in claim 1, wherein the pressure means comprises two parts, a pressure member on the front plate and a release member on the rear plate.

3. A clip as claimed in claim 2, wherein the release member, in a closed position of the clip, projects through an aperture in the front plate.

4. A clip as claimed in claim 3 wherein the release member has latch means thereon for locking the front plate relative to the rear plate.

5. A clip as claimed in claim 4, wherein the latch means comprises a locking rib for interengagement with an edge of the aperture through the front plate.

6. A clip as claimed in claim 4, wherein the latch means comprises a plurality of teeth on the release arm and an interlocking tooth on the front plate.

7. A clip as claimed in claim 6, wherein the interlockable tooth is located on a flange of the front plate.

8. A clip as claimed in claim 7, characterised in that the flange extends from the edge of the aperture in the front plate adjacent a free end of the front plate across the plurality of teeth on the release arm.

9. A clip as claimed in claim 1, wherein the first gripping plate means is a front plate and the second gripping plate means is a rear plate.

10. A clip as claimed in any claim 9, including a strengthening rib extending transversely relative to the release means.

11. A clip as claimed in claim 9, wherein the strengthening rib includes an end face engageable in an open position of the clip by the pressure means on the front plate.

12. A clip as claimed in claim 10, wherein that the end face includes a step therein.

13. A clip as claimed in claim 10, wherein the pressure means includes an angled edge thereof for engagement with the end face of the strengthening rib to more securely interlock the gripping plates.

14. A clip as claimed in claim 9 wherein the front and rear plates are pivotally interconnected by a hinge along one edge thereof.

15. A clip as claimed in claim 1, wherein the pressure member comprises side members projecting perpendicularly from the front plate and a plate mounted on and extending between the side members at free ends thereof.

16. A clip as claimed in claim 1 wherein the clip is one piece integral moulding.

17. A clip as claimed in claim 15, wherein the clip is of a soft clear plastics material.

18. A clip as claimed in claim 15, wherein the material is of K-Resin.

* * * * *